US007963490B2

(12) United States Patent
Pritchard

(10) Patent No.: US 7,963,490 B2
(45) Date of Patent: Jun. 21, 2011

(54) RIDGE CLIP

(76) Inventor: Aaron Pat Pritchard, Wingate, TX (US)

( * ) Notice: Subject to any disclaimer, the term of this patent is extended or adjusted under 35 U.S.C. 154(b) by 170 days.

(21) Appl. No.: 12/323,723

(22) Filed: Nov. 26, 2008

(65) Prior Publication Data

US 2009/0133350 A1 May 28, 2009

Related U.S. Application Data

(60) Provisional application No. 61/004,213, filed on Nov. 26, 2007, provisional application No. 61/097,275, filed on Sep. 16, 2008.

(51) Int. Cl.
*A47F 7/00* (2006.01)

(52) U.S. Cl. ..... 248/215; 248/213; 248/211; 248/290.1

(58) Field of Classification Search ..... 248/237, 248/309.1, 316.1, 316.7, 300
See application file for complete search history.

(56) References Cited

U.S. PATENT DOCUMENTS

| | | | | |
|---|---|---|---|---|
| 5,056,747 | A | 10/1991 | Kireta | |
| 5,249,108 | A * | 9/1993 | Gary | 362/388 |
| 5,544,031 | A | 8/1996 | Blanton | |
| 5,669,709 | A | 9/1997 | Adams | |
| 5,772,166 | A | 6/1998 | Adams | |
| 2007/0223221 | A1 | 9/2007 | George | |

OTHER PUBLICATIONS

Partial European Search Report for co-pending European Patent Application No. EP08170011.

* cited by examiner

*Primary Examiner* — Amy J Sterling
*Assistant Examiner* — Erin Smith
(74) *Attorney, Agent, or Firm* — Sean C. Crandall; Jackson Walker LLP

(57) ABSTRACT

A ridge clip is disclosed that is useful for attaching lights or other decorations to the ridge of a roof without compromising the seal on ridge shingles. The ridge clip includes a shingle hook that affixes to the overhanging portion of a shingle, and an extension arm that extends long enough to mount the decoration on the roof ridge. Ridge clips may be provided as an adapter for existing shingle tabs, or as stand-alone devices.

6 Claims, 6 Drawing Sheets

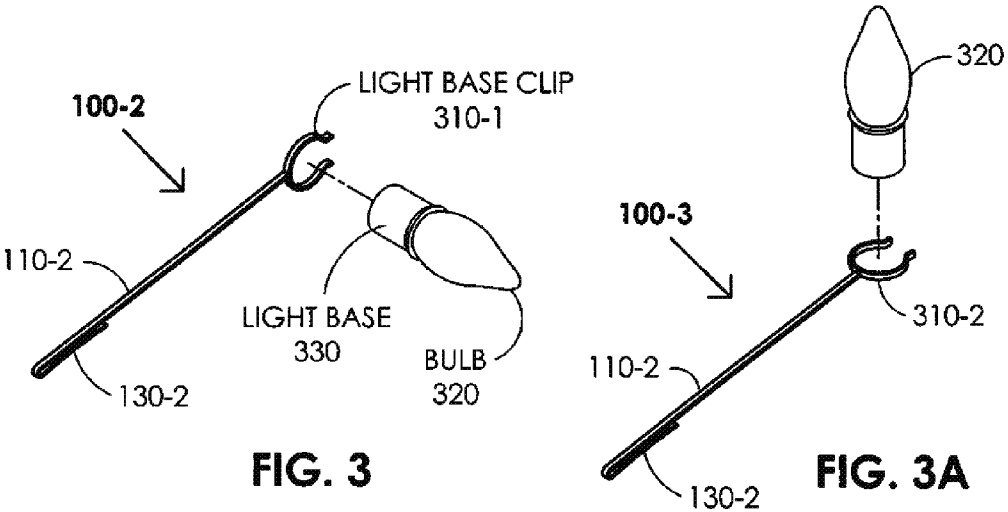
FIG. 3
FIG. 3A
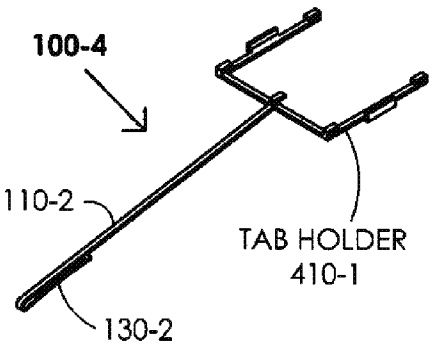
FIG. 4
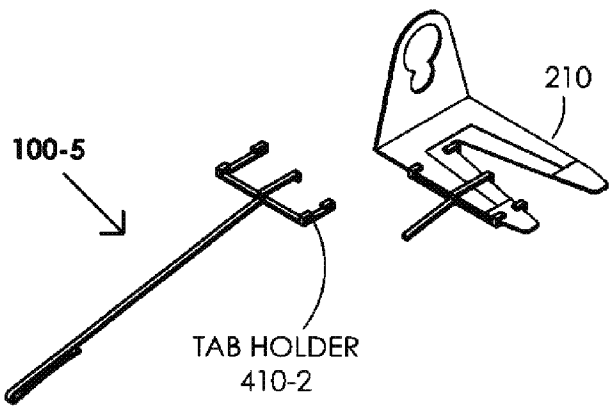
FIG. 5
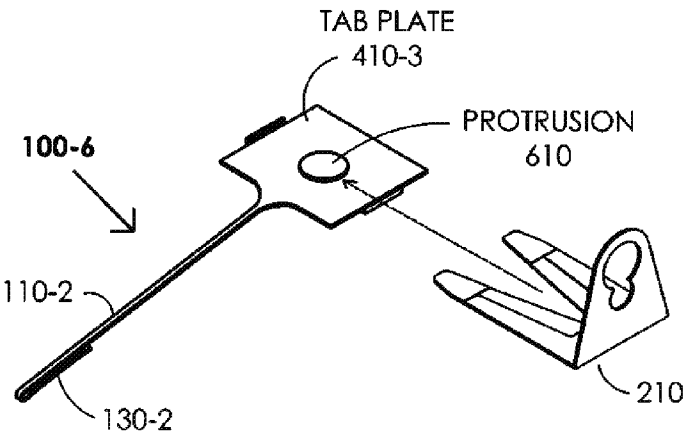
FIG. 6

RIDGE CLIP

CROSS REFERENCE TO RELATED APPLICATIONS

This application claims the benefit of U.S. Provisional Application 61/004,213 filed Nov. 26, 2007, and U.S. Provisional Application 61/097,275 filed Sep. 16, 2008.

BACKGROUND

This specification relates to the field of home decorations, and more particularly to a ridge clip useful for mounting decorations on the ridge of a roof.

Many people enjoy stringing lights on their homes for Christmas and other holidays. One method of mounting lights to a roof is the use of a prior art shingle tab, which slides under the overhanging flap of a shingle. Shingle tabs are also sometimes used on the ridge of a roof by sliding it under ridge shingles, which run perpendicular to the regular shingles.

BRIEF DESCRIPTION OF THE DRAWINGS

FIG. 3 is a perspective view of an alternative embodiment of a ridge clip, including a light base clip oriented horizontally;

FIG. 3A is a perspective view of a ridge clip with a light base clip oriented vertically;

FIG. 4 is a perspective view of a ridge clip, including a tab holder configured to receive a shingle tab;

FIG. 5 is a perspective view of a ridge clip also configured to receive a shingle tab;

FIG. 6 is yet another perspective view of a ridge clip configured to receive a shingle tab;

SUMMARY OF THE INVENTION

Figure 1:
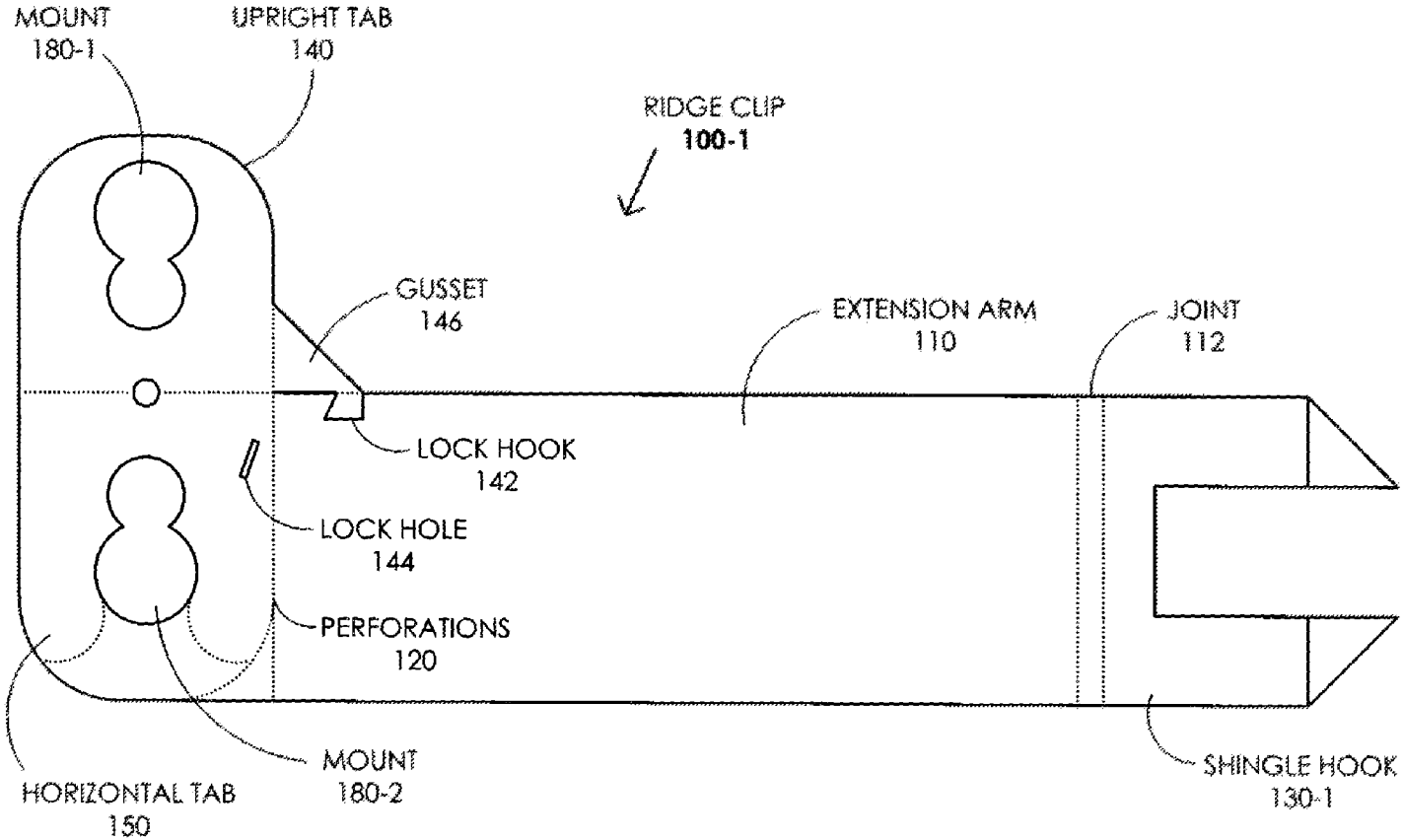
FIG. 1 is a top view of an embodiment of a ridge clip, shown as produced.

In one aspect, a ridge clip is useful for attaching lights or other decorations to the ridge of a roof without compromising the seal on ridge shingles. The ridge clip includes a shingle hook that affixes to the overhanging portion of a shingle, and an extension arm that extends long enough to mount the decoration on the roof ridge. Ridge clips may be provided as an adapter for existing shingle tabs, or as stand-alone devices.

DETAILED DESCRIPTION OF THE EMBODIMENTS

A ridge clip provides an improved method of displaying lights and other decorative items along the ridge of a roof. Advantageously, the disclosed ridge clip permits a decorative item to be mounted along the ridge without compromising the seal of the ridge, because the ridge clip affixes to the overhanging part of a shingle beneath the ridge cap.

A ridge clip will now be described with more particular reference to the attached drawings. Hereafter, details are set forth by way of example to facilitate discussion of the disclosed subject matter. It should be apparent to a person of ordinary skill in the field, however, that the disclosed embodiments are exemplary and not exhaustive of all possible embodiments. Throughout this disclosure, a hyphenated form of a reference numeral refers to a specific instance or example of an element and the un-hyphenated form of the reference numeral refers to the element generically or collectively. Thus, for example, 102-1 may refer to a "pen," which may be an instance or example of the class of "writing implements." Writing implements may be referred to collectively as "writing implements 102" and any one may be referred to generically as a "writing implement 102."

FIG. 1 discloses a top view of a ridge clip 100-1, as it may appear when newly purchased and before it is configured for final use. A ridge clip 100 includes an overhang engagement member 130, which is adapted to engage the overhanging portion of a shingle 192 (FIG. 1B). In the embodiment shown in FIG. 1, the overhang engagement member 130 is a shingle clip 130-1, but in other embodiments, it may be any other kind of clip, adhesive, or other affixing means adapted to securely engage the overhanging portion of the shingle. A joint 112 joins shingle hook 130-1 to extension arm 110. Extension arm 110 is designed with a length sufficient to extend up to the ridge cap. For example, in one embodiment, the extension arm extends approximately six inches, or between six and seven inches, and is two inches wide. Joint 112 is a flexible member and may be created with perforations or other hinge, thus allowing the shingle clip to hingedly flex underneath extension arm 110. At a removed end, extension arm 110 is affixed to a mount 180, which is adapted to receive a decorative item such as a light bulb in the disclosed embodiment, mount 180 includes two holes. The larger hole is adapted to receive a C7-size bulb, and the smaller hole is adapted to receive a C9-size bulb. In this embodiment, mount 180 includes two options for displaying the decorative item. A horizontal tab 150 is useful if the decorative item is to be oriented vertically with respect to the ridge cap. An upright tab 140 is useful if the decorative item is to be oriented horizontal with respect to the ridge cap. If upright tab 140 is to be used, it may be vertically supported by gusset 146 which joins lock hook 142. Lock hook 142 may engage lock hole 144 for stability. Also disclosed are perforations 120 which extends upwards across gusset and horizontally across upright tab 140. The perforations 120 may be provided to allow reconfiguration of the ridge clip 100-1. For example, if the decorative item is to be oriented vertically, gusset 146 and upright tab 140 may be removed.

Figure 1A:
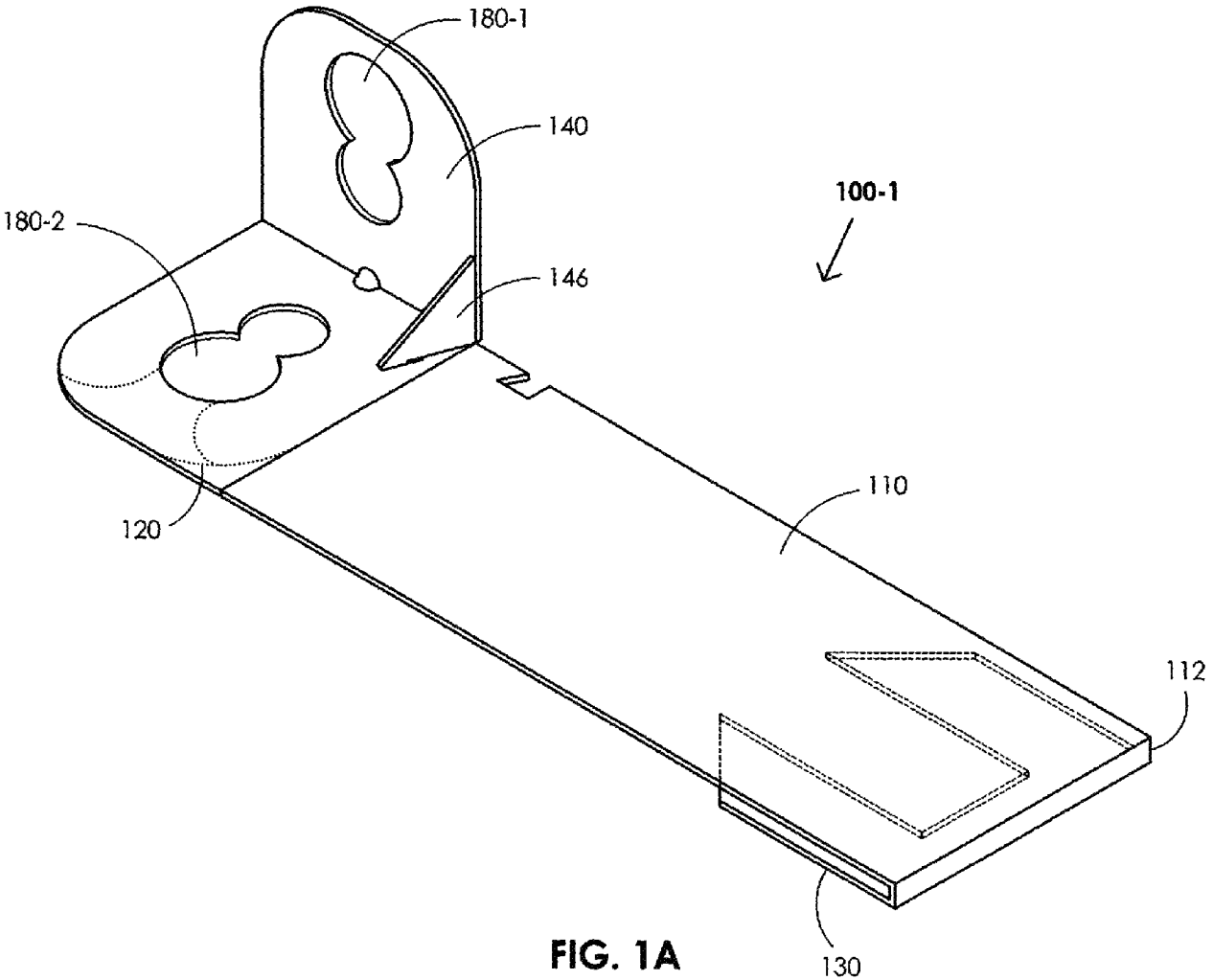
FIG. 1A is a perspective view of the ridge clip of FIG. 1 in modified for use.
Figure 1B:
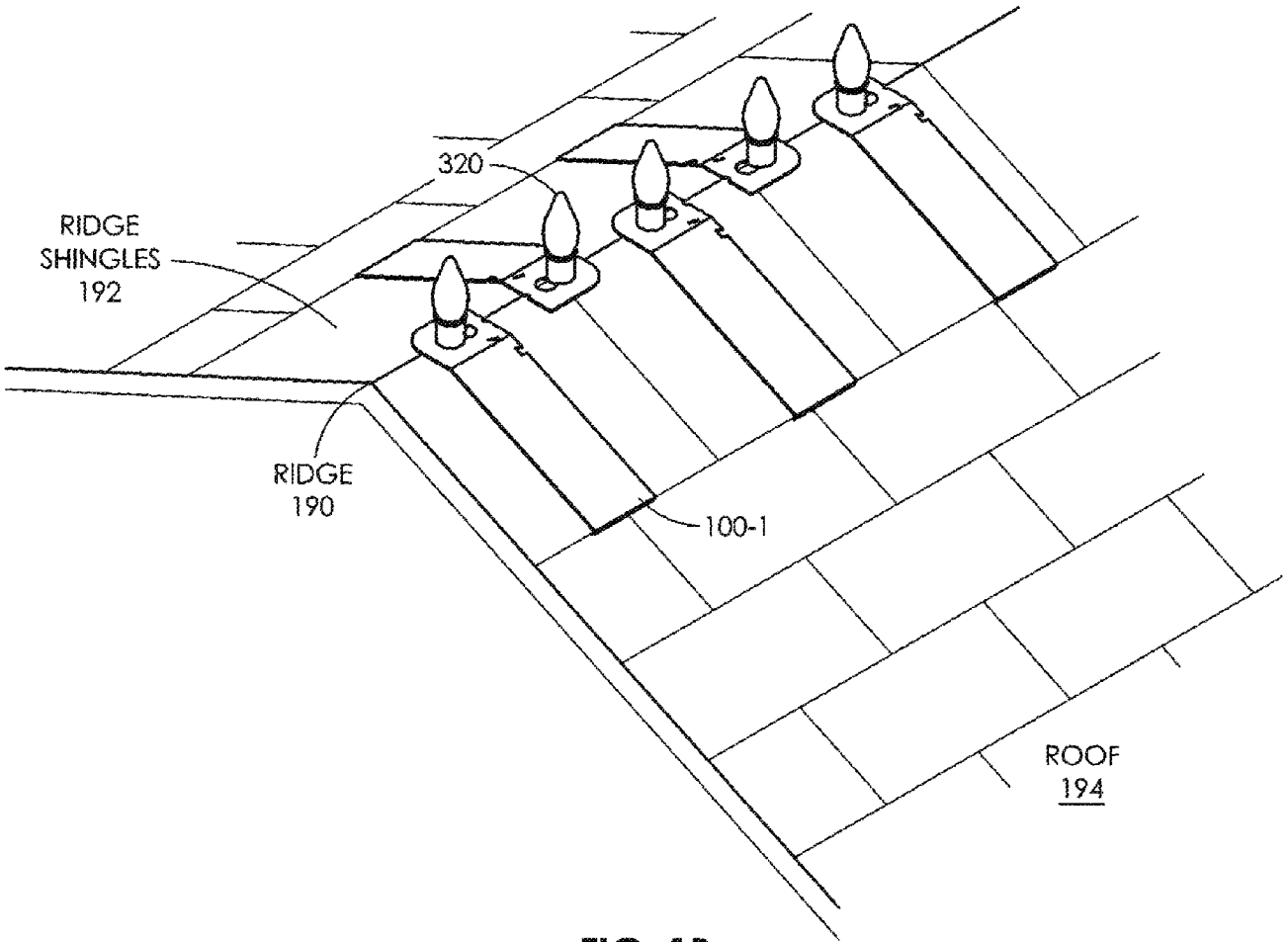
FIG. 1B discloses a perspective view of a roof with a ridge on which ridge clips are displayed.

FIG. 1A discloses a perspective view of the ridge clip of FIG. 1 in an alternative configuration. In this configuration, it is seen that shingle hook 130 has been hinged under extension arm 110 at joint 112. Thus configured, ridge clip 100-1 is ready to engage an overhanging shingle. Also seen in this view, an upright tab 140 has been raised along perforation 120. As shown, gusset 146 has been disengaged from extension arm 110 and lock hook 142 has engaged lock hole 144.

FIG. 1B discloses a perspective view of a roof 194 with a ridge 190 on which ridge clips 100 are displayed. Ridge clip 100 engage the overhanging portion of ridge shingles 192, thus maintaining the integrity of the seal. For display purposes, ridge clips 100 are distributed along ridge 190 on alternating sides of ridge 190.

Figure 2:
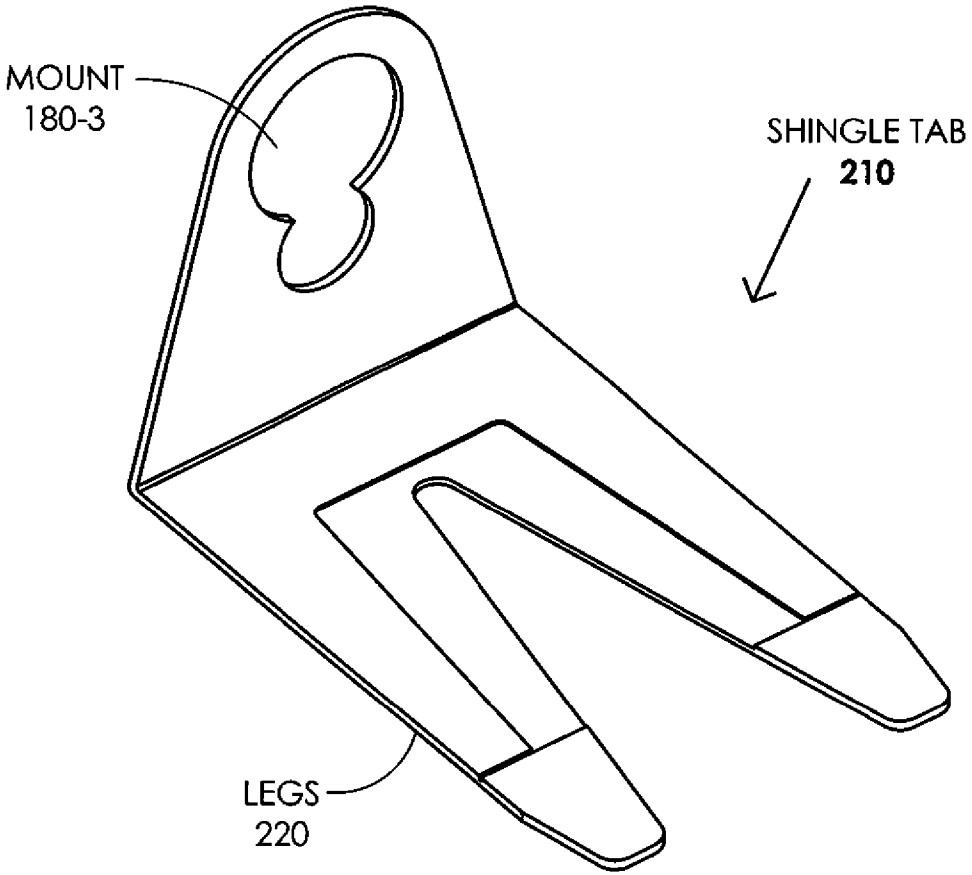
PRIOR ART FIG. 2
FIG. 2 is a perspective view of a prior art shingle tab.

FIG. 2 discloses a perspective view of a prior art shingle tab 210. Prior art shingle tab 210 includes legs 220 adapted to engage the overhanging portion of a shingle. Also shown is mount 180-3 which is oriented vertically with respect to the legs 220. The shingle tab 210 as disclosed is suitable primarily for insertion under the overhanging portion of a shingle but does not reach the ridge cap 190. In some cases, it has also been used along the ridge of a roof. In this case it must be inserted into the ridge cap shingles 192 at the apex of the ridge cap 190, rather than the overhanging portion, which in some cases may compromise the seal.

FIG. 3 discloses a perspective view of an alternative embodiment of a ridge clip 100-2, including a light base clip oriented horizontally. In this case, extension arm 110-2 is a narrow rod. As with other embodiments, the extension arm 110-2 is approximately six inches, and generally between six and seven inches long. Shingle hook 130-2 is permanently molded in place. In this case there is no need for joint 112 or perforations 120. In this embodiment of a ridge clip 100-2, a light base clip 310-1 is provided. This is particularly suitable for use with a bulb 320, which is a form of decorative item. Bulb 320 may include a light base 330. Light base clip 310-1 is configured to snap snugly around light base 330, thus holding bulb 320 in place. Light base clip 310-1 may be constructed of flexible plastic, or other flexible material, so that it may snap tightly around either a C9 size light, or may expand to snap around a C7 size light. In FIG. 3 it is shown that light base clip 310-1 is oriented so that bulb 320 would be aligned horizontally along the ridge 190, or in other words bulb 320 will lie substantially along the top of the ridge.

FIG. 3A discloses a perspective view of a ridge clip with a light base clip oriented vertically. In this embodiment, ridge clip 100-3 is substantially similar to the ridge clip 100-2 of FIG. 3. In this case, however, light base clip 310-2 is oriented so as to hold bulb 320 substantially in a vertical orientation. In this embodiment, bulb 320 will appear to be standing straight up from the apex of the roof ridge 190.

FIG. 4 discloses a perspective view of a ridge clip, including a tab holder configured to receive a shingle tab. In this case, ridge clip 100-4 is an adaptor for receiving a prior art shingle tab. Ridge clip 100-4 includes a tab holder 410 which in this case is a tab frame. Tab frame 410-1 is adapted to receive and securely hold a shingle tab 210.

FIG. 5 discloses a perspective view of a ridge clip also configured to receive a shingle tab. In this case, ridge clip 100-5 includes a different embodiment of a tab holder 410, specifically a clasp 410-2. Clasp 410-2 is adapted to receive one leg 220 of the shingle tab 210 by slidably engaging the leg to securely hold it.

FIG. 6 discloses another perspective view of a ridge clip configured to receive a shingle tab. This embodiment includes another embodiment of an adaptor for holding a shingle tab 210. In this case, a tab plate 410-3 is adapted to receive shingle tab 210. Tab plat 630 includes a protrusion 610, preferably molded on to tab plate 410, which is adapted to receive legs 220 of shingle tab 210. Shingle tab 210 may thus mount securely to tab plate 410-3. Although protrusion 610 is shown substantially circular, it may also be another shape adapted to engage legs 220, such as an oval or rhombus.

Figure 7:
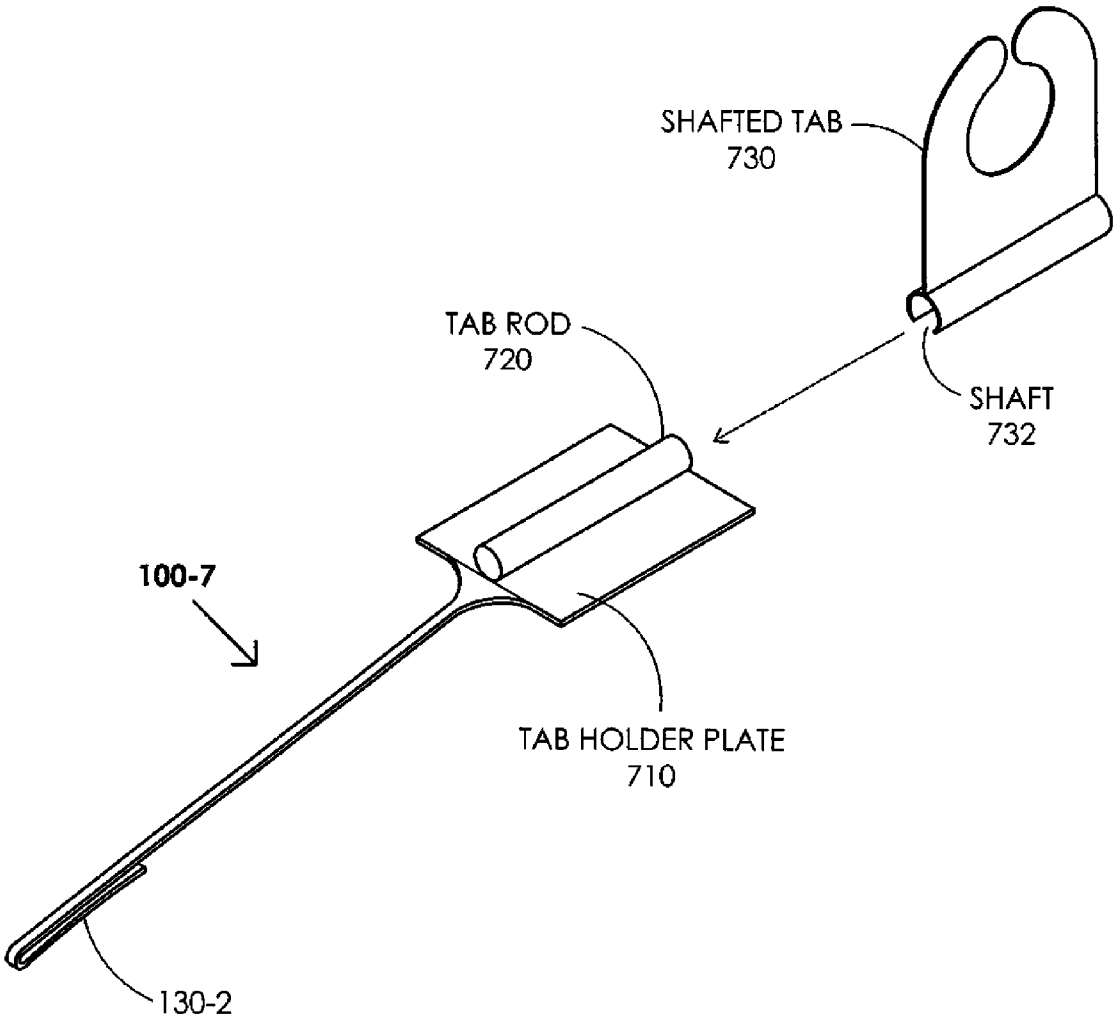
FIG. 7 is a perspective view of a ridge clip including a tab rod, and adapted to receive a shafted tab.

FIG. 7 discloses a perspective view of a ridge clip including a tab rod 720, and adapted to receive a shafted tab 730. In this case, ridge clip 100-7 includes a tab holder plate 710 upon which is rigidly affixed a tab rod 720. Tab rod 720 is configured to receive a shaft 732. A shafted tab 730 is provided which includes shaft 732 adapted to slidably engage tab rod 720. Thus shafted tab 730 may slide on its shaft 732 along tab rod 720, and thus be secured to ridge clip 100-7.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. A ridge clip for displaying a decorative item on an apex of a roof ridge, the ridge clip comprising:

an overhang engagement member hookingly engages the overhanging portion of a roof shingle;

an extension arm affixed at a near end to the overhang engagement member;

a mount receive a decorative item and affixed to a removed end of the overhand engagement member;

wherein the extension arm has a length and orientation to position the mount substantially at the apex of a ridge, the orientation being in a direction opposite to a slope of the roof;

whereby the ridge clip permits the decorative item to be displayed along the ridge of a roof without compromising a seal of a ridge shingle, and the decorative item is substantially visible from both sides of the roof.

2. The ridge clip of claim 1 wherein the extension arm is statically affixed to the near end of the overhang engagement member.

3. The ridge clip of claim 1 wherein the mount is rigidly affixed to the removed end of the extension arm.

4. The ridge clip of claim 1 wherein the mount is oriented to orient the decorative item horizontally.

5. The ridge clip of claim 1 wherein the mount includes a clip engage the decorative item.

6. The ridge clip of claim 5 wherein the decorative item is a light bulb having a base, and the clip engages the base.

* * * * *